US006853146B2

(12) United States Patent
Troussel et al.

(10) Patent No.: US 6,853,146 B2
(45) Date of Patent: Feb. 8, 2005

(54) METHOD AND CIRCUIT FOR CONTROLLING A PLASMA PANEL

(75) Inventors: Gilles Troussel, Grenoble (FR); Céline Mas, Poisat (FR); Eric Benoit, Quaix en Chartreuse (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 10/110,449

(22) PCT Filed: Aug. 9, 2001

(86) PCT No.: PCT/FR01/02590

§ 371 (c)(1),
(2), (4) Date: Jul. 23, 2002

(87) PCT Pub. No.: WO02/15163

PCT Pub. Date: Feb. 21, 2002

(65) Prior Publication Data

US 2003/0057852 A1 Mar. 27, 2003

(30) Foreign Application Priority Data

Aug. 11, 2000 (FR) ..... 00 10609

(51) Int. Cl.[7] ..... G09G 3/10; G09G 5/00
(52) U.S. Cl. ..... 315/169.3; 345/204
(58) Field of Search ..... 315/169.1, 169.2, 315/169.4, 169.3; 362/80, 82, 85, 88, 90; 345/29, 204, 698

(56) References Cited

U.S. PATENT DOCUMENTS

| | | | | |
|---|---|---|---|---|
| 4,316,123 A | | 2/1982 | Kleen et al. | |
| 5,237,315 A | * | 8/1993 | Gay et al. | 345/55 |
| 5,867,135 A | * | 2/1999 | Salavin et al. | 345/68 |
| 5,909,401 A | * | 6/1999 | Sharma et al. | 365/189.05 |
| 5,914,900 A | * | 6/1999 | Sharma et al. | 365/189.08 |
| 6,097,214 A | * | 8/2000 | Troussel et al. | 326/63 |
| 6,275,070 B1 | * | 8/2001 | Pantelakis et al. | 326/98 |
| 6,370,275 B1 | * | 4/2002 | Benoit et al. | 382/237 |
| 6,400,343 B1 | * | 6/2002 | Zorzan et al. | 345/60 |

FOREIGN PATENT DOCUMENTS

EP 0 837 443 A1 4/1998

OTHER PUBLICATIONS

International Search Report from priority application No. PCT/FR01/02590 filed Aug. 9, 2001.

* cited by examiner

*Primary Examiner*—Tan Ho
*Assistant Examiner*—Minh Dieu A
(74) *Attorney, Agent, or Firm*—Lisa K. Jorgenson; William R. McClellan; Wolf, Greenfield & Sacks, P.C.

(57) ABSTRACT

A method for controlling cells of a plasma screen of array type, formed of cells arranged at the intersections of lines and columns, including the step of sequentially applying to each line an activation potential and, during the activation of a line, applying an activation potential to selected columns, in which, while a line is activated, the selected columns are non-simultaneously activated.

18 Claims, 4 Drawing Sheets

METHOD AND CIRCUIT FOR CONTROLLING A PLASMA PANEL

BACKGROUND OF THE INVENTION

1. Field of the Invention

The present invention relates to plasma screens and more specifically to the control of cells of a plasma screen.

2. Discussion of the Related Art

A plasma screen is an array type screen formed of cells arranged at the intersections of lines and columns. A cell includes a cavity filled with a rare gas, and at least two control electrodes. To create a light point on the screen, by using a given cell, the cell is selected by applying a potential difference between its control electrodes, after which the cell gas is ionized, generally by means of a third control electrode. This ionization goes along with an emission of ultraviolet rays. The creation of the light point is obtained by excitation of a red, green or blue luminescent material by the emitted rays.

FIG. 1 shows a conventional structure of a plasma screen formed of cells 4. Each cell 4 has two control electrodes respectively connected to a line 6 and to a column 8.

The selection of the cells, to create images, is performed, conventionally, by logic circuits generating control signals. The logic states of these signals determine the cells that are controlled to generate a light point and those that are controlled not to generate one. The ionization of a gas of a cell requires that potentials on the order of some hundred volts be applied between the two control electrodes for a predetermined duration, on the order of 2 microseconds. Each cell has an equivalent capacitance on the order of several tens of picofarads.

FIG. 2 shows a plasma screen, the cells 4 of which are represented by an equivalent capacitor. A line control circuit 10 includes, for each line 6, a line control block 14, an output of which is connected to line 6. A column control circuit 12 includes, for each column 8, a column control block 18, an output 20 of which is connected to column 8. Circuits 10 and 12 are generally integrated on a same semiconductor chip.

Conventionally, the cells of a plasma screen are activated line by line. The non-activated lines are set to a quiescent voltage VDD1 (for example, 150 V). The activated line is brought to an activation voltage GND (0 V). To light chosen points of the activated line, the corresponding columns are brought to a voltage VDD2 (80 V). The columns corresponding to the other points of the activated line are brought to voltage GND (0 V). Thus, the lit cells of the activated line see a column-line voltage equal to VDD2−GND (80 V) and the unlit cells of the activated line see a column-line voltage equal to GND−GND (0 V). For all non-activated lines, the line voltage is VDD1 (150 V) and the column voltage is 0 or 80 V. In both cases, the cells of the non-activated lines are reverse biased.

Each line control block 14 includes a pair of complementary power transistors 22 and 24. Transistor 24 receives voltage VDD1 on its source. Its drain is connected to a line 6 and its gate receives a line deactivation control signal LSN. The source of transistor 22 is connected to voltage GND. Its drain is connected to line 6 and its gate receives a control signal LS complementary to signal LSN. Signals LS and LSN are generated, for example, by a microprocessor, not shown.

Each column control block 18 includes an output stage 26 including a couple of power transistors (not shown) enabling bringing output 20 to voltages VDD2 or GND according to a logic column selection signal LCS provided to stage 26. Each control block 18 also includes a memory element 28 connected, for example, to a microprocessor, not shown, for receiving and storing the value of logic signal LCS intended for output stage 26. Each control block 18 further includes a logic switch 30 controlled by an enable signal VAL, connected between memory element 28 and output stage 26. Logic switch 30 is provided to provide an inactive signal to output stage 26 as long as enable signal VAL is inactive, for example at a low logic level. Switch 30 is also provided for, when signal VAL is active, providing output stage 26 with signal LCS stored in memory element 28. Signal VAL is conventionally activated for a predetermined duration after each activation of a screen line.

FIG. 3 is a timing diagram illustrating voltage V6 of a line 6, enable signal VAL, voltage V8 of a column 8, and current I22 in transistor 22 of line control circuit 14. At a time t0, the line is selected and voltage V6 switches from voltage VDD1 to voltage GND. Voltage V8 then is at GND. At a time t1, signal VAL is activated and column 8 is connected to potential VDD2, for a point to be lit. The selected cell charges between time t1 and a time t2 and voltage V8 switches from GND to VDD2. During this charge, transistor 22 conducts a first current peak P1. For physical reasons associated with the cell structure, a short time after this first current peak, a second current peak P2, more intense than the first one, occurs between times t3 and t4. As an example, time t1 may occur from 10 to 20 ns after time t0, time t2 may occur from 50 to 100 ns after time t1, and times t3 and t4 may occur from 150 to 200 ns after times t1 and t2, respectively. The charge of a cell can correspond to current peaks P1 and P2 respectively of 0.1 and 0.3 mA. A control circuit is conventionally used to control more than 3000 columns. Thus, if all the columns 8 of a selected line must be lit, the second current peak crossing transistor 22 can reach 1 A. Transistors 22 must have a large size to be able to conduct such a current.

SUMMARY OF THE INVENTION

An object of the present invention is to provide a control circuit of the cells of a plasma screen, which is of reduced size and low cost.

To achieve this object, the present invention provides delaying the selection of the different columns so that the charge of the equivalent capacitors of the cells in a same screen line is not simultaneous.

More specifically, the present invention provides a method for controlling cells of a plasma screen of array type, formed of cells arranged at the intersections of lines and columns, including the step of sequentially applying to each line an activation potential and, during the activation of a line, applying an activation potential to selected columns, in which, while a line is activated, the selected columns are non-simultaneously activated.

According to an embodiment of the present invention, the activation of the selected columns is controlled by a single signal activating several control blocks, each of which controls with a specific delay the application of the activation potential to the column.

The present invention also aims at a circuit for controlling the cells of a plasma screen of array type, formed of cells arranged at the intersections of lines and columns, including line control blocks for sequentially applying, to each line, an activation potential, and including column control blocks for, as each line is activated, applying an activation potential to selected columns, each column control block including a means with a predetermined delay for delaying the application of the activation potential to the selected columns.

According to an embodiment of the present invention, the predetermined delay means of each column control block is connected to be activated by a same enable signal.

According to an embodiment of the present invention, each predetermined delay means delays the application of the activation potential to a selected column with a predetermined delay from its activation.

According to an embodiment of the present invention, each column control block includes:

- an output stage coupled to the column activated by the control block, and receiving an input signal,
- a memory element for receiving and storing a column selection signal, and
- a predetermined delay means including a NAND gate having a first input connected at the output of the memory element, a second input which receives said enable signal and an output connected to the input of the output stage via an inverter including a P-type MOS transistor, the dimensions of which are such that said inverter switches at a predetermined speed.

According to an embodiment of the present invention, the column control blocks form several groups, the column control blocks of a same group each activating a column with a same predetermined delay and each column control block including:

- an output stage coupled to the column activated by the control block, and receiving an input signal,
- a memory element for receiving and storing a column selection signal, and
- a predetermined delay means including a NAND gate having a first input connected at the output of the memory element, a second input which receives said enable signal and an output connected to the input of the output stage via an inverter supplied between a ground and a supply node, the supply nodes of the column control blocks of a same group being interconnected and separated from the supply nodes of the other column control blocks by a resistor, the supply nodes of a first group of column control blocks being connected to a supply voltage.

The foregoing and other objects, features and advantages of the present invention will be discussed in detail in the following non-limiting description of specific embodiments, in conjunction with the accompanying drawings, in which:

DETAILED DESCRIPTION

Figure 1:
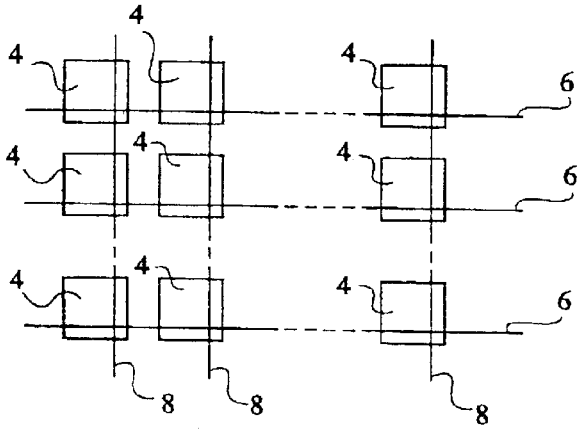
FIG. 1, previously described, schematically shows a conventional plasma screen structure.
Figure 2:
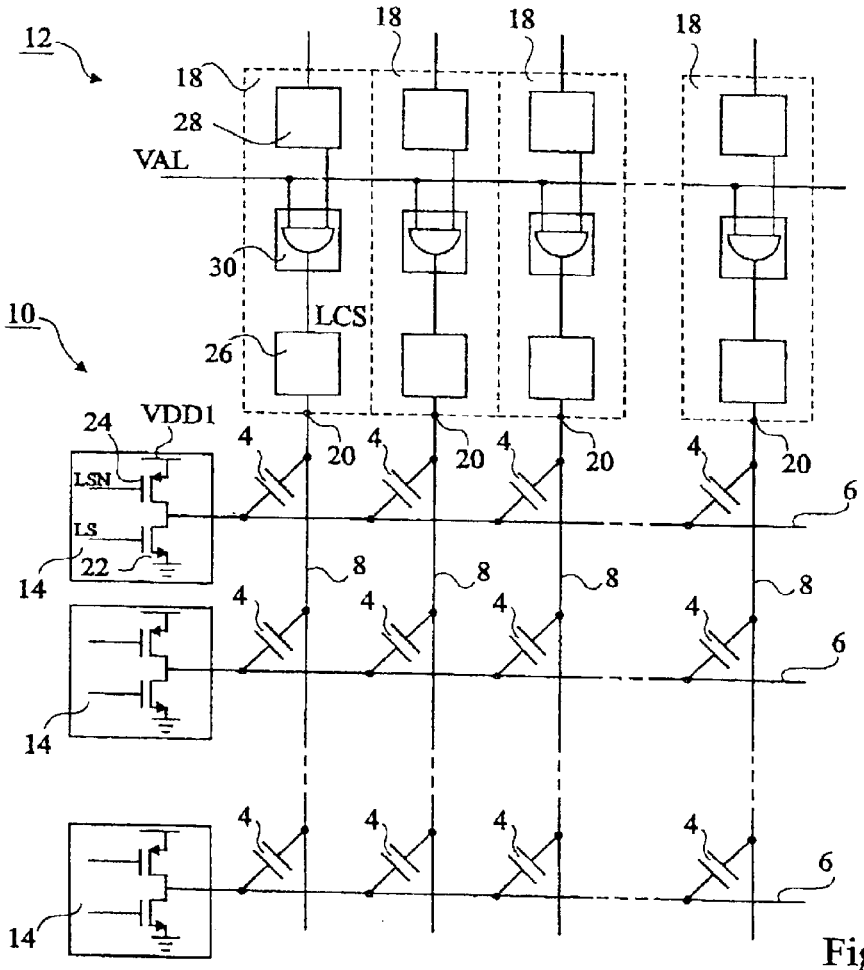
FIG. 2, previously described, schematically shows a plasma screen connected to a conventional control circuit.
Figure 3:
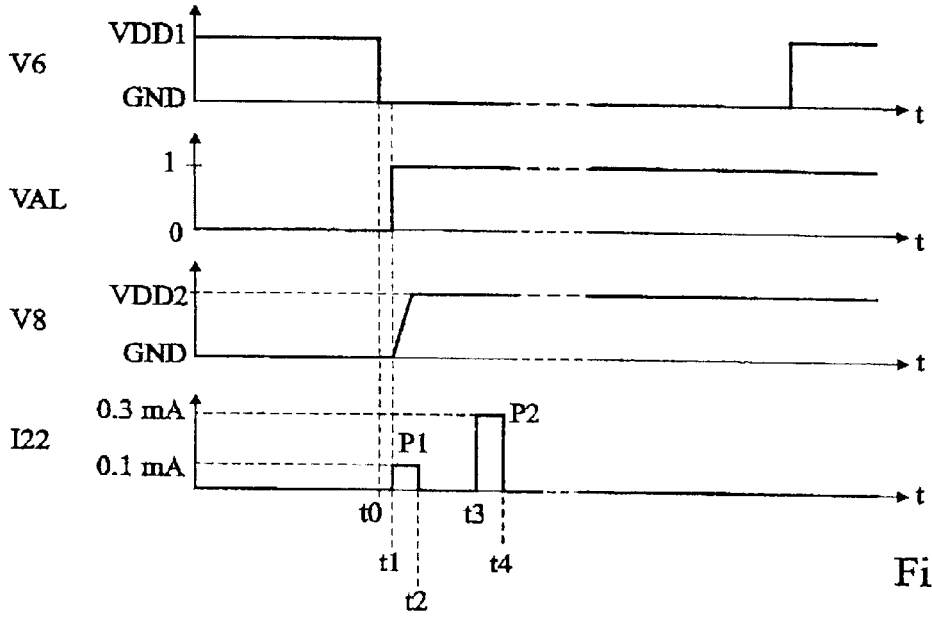
FIG. 3, previously described, illustrates the charge of a cell of a line of the screen of FIG. 2.

In the drawings, only those elements necessary to the understanding of the present invention have been shown. The same references represent the same elements in the difference drawings.

Figure 4:
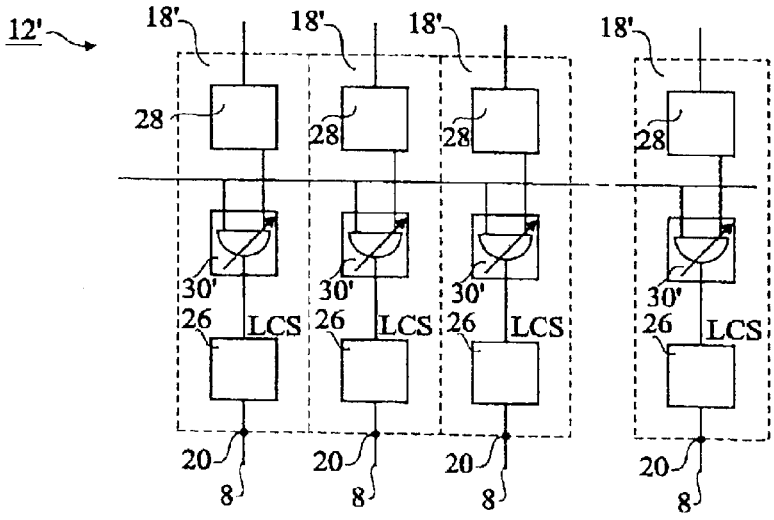
FIG. 4 schematically shows column control blocks according to the present invention.

FIG. 4 schematically shows a circuit 12' for controlling the columns of a plasma screen (not shown) according to the present invention. Circuit 12' includes, for each column 8 of the plasma screen, a column control block 18', an output 20 of which is connected to column 8. Each control block 18' includes an output stage 26 controlled by a logic column activation signal LCS, and a memory element 28 connected to receive and store the value of the logic signal to be provided to stage 26. Each control block 18' further includes a logic switch 30' controlled by an enable signal VAL and connected between memory element 28 and output stage 26. According to the present invention, the logic switch 30' of each control block 18' is provided for, when signal VAL is activated, providing the signal LCS stored in memory element 28 to output stage 26 with a predetermined delay. The logic switches 30' of the different blocks 18' may each introduce a different delay with respect to signal VAL, or they may be distributed into several groups of switches introducing the same delay. As the number of blocks 18' introducing a different delay is increased, the number of cells is reduced, and therefore the number of equivalent capacitors of the cells which need to be simultaneously charged is reduced, and therefore the maximum current conducted by transistor 22 is reduced.

Figure 5:
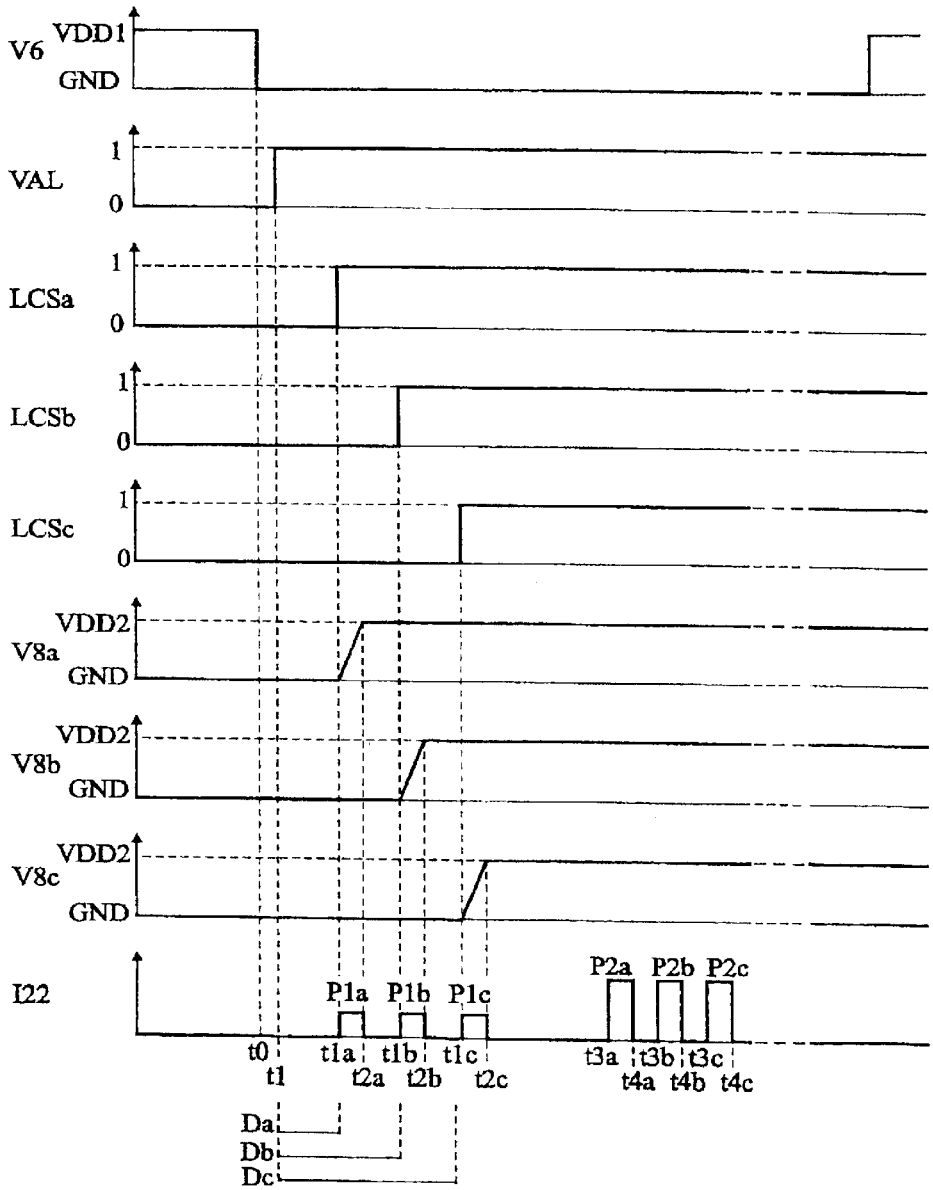
FIG. 5 illustrates the charge of cells of a line of a plasma screen controlled by the control circuit according to the present invention.

FIG. 5 shows various voltages and currents appearing upon operation of the circuit of FIG. 4. V8a, V8b, V8c represent the voltages of three columns connected to three blocks 18' according to the present invention, the logic switches of which respectively introduce delays Da, Db, Dc. At a time t0, a line 6 is selected and its voltage V6 switches from potential VDD1 to potential GND. Voltages V8a, V8b, V8c then are at voltage GND. Signal VAL is activated at a time t1. The logic switches 30' of the three blocks 18' respectively generate activation signals LCSa, LCSb, LCSc at times t1a, t1b, t1c delayed by Da, Db, Dc with respect to time t1. Columns 8*a*, 8*b*, and 8*c* are connected to potential VDD2 substantially at times t1a, t1b, and t1c. The capacitors of the cells connected to columns 8*a*, 8*b*, and 8*c* respectively charge between times t1a and t2a, t1b and t2b, t1c and t2c. Transistor 22 conducts first current peaks P1*a*, P1*b*, P1*c* on the order of 0.1 mA, each during the charge of each of the three capacitors. As seen previously, each charge is followed by a second current peak. Transistor 22 conducts three second current peaks P2*a*, P2*b*, P2*c* on the order of 0.3 mA, each between times t3a and t4a, t3b and t4b, t3c and t4c. When all the columns 8 of a line must be lit by a by a column control circuit according to the present invention, the maximum current conducted by transistor 22 is only equal to the sum of the current peaks generated by blocks 18' introducing the same delay. If, for example, blocks 18' are distributed in three groups a, b, c respectively introducing a delay Da, Db, Dc, the present invention reduces by a factor of three the maximum current in transistor 22.

It should be noted that in FIG. 5, the illustrated charge durations, that is, the width of the current peaks, and delays Da, Db, Dc, are such that the current peaks corresponding to the different delays are distinct. In practice however, the charge durations and the delays may be such that the different peaks overlap.

Figure 6:
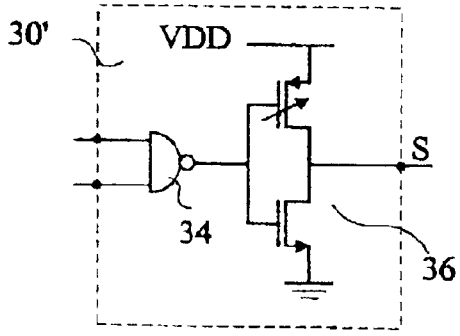
FIG. 6 schematically shows an embodiment of a logic switch of a column control block according to the present invention.

FIG. 6 schematically shows an embodiment of a logic switch 30'. Switch 30' includes a conventional NAND gate 34. The two input terminals of gate 34 are the two input terminals of logic switch 30'. The output of gate 34 is connected to output S of switch 30' via an inverter 36. Inverter 36 includes an N-type MOS transistor connected between the ground and output S and a P-type MOS transistor connected between output S and a supply line VDD, for example 3 or 5 V. According to the present invention, the width-to-length ratio (W/L) specific to the P-type MOS transistor of inverter 36 is used to obtain a specific delay. The W/L ratio of the P-type transistor especially determines the current that can be conducted by this transistor, and thereby, the speed at which switch 30' can bring a load (stage 26) connected to its output S to a voltage corresponding to a high logic state. Thus, the W/L ratio of the P-type MOS transistor of inverter 36 enables adjusting the delay introduced by logic switch 30'.

Figure 7:
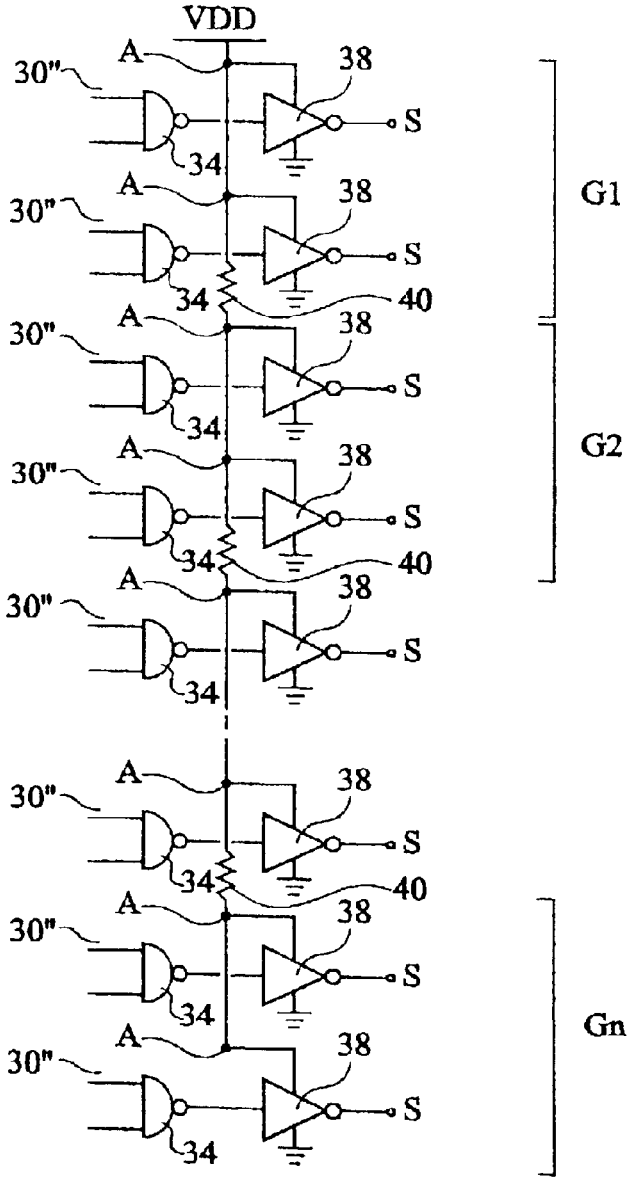
FIG. 7 schematically shows another embodiment of the logic switch of a column control block according to the present invention.

FIG. 7 shows logic switches 30" of a control circuit according to another embodiment of the present invention. Each logic switch 30" includes a NAND gate 34, the inputs of which form the inputs of the logic switch, and the output of which is connected to output S of logic switch 30" via an inverter 38. Each inverter 38 is supplied between a supply node A and the ground. According to the present invention, the logic switches 30" are distributed into n groups G1, G2, . . . Gn (where n is an integer), introducing different delays. FIG. 7 shows groups of two switches 30". Nodes A of switches 30" belonging to a same group are interconnected. Nodes A of the switches of group G1 are connected to a supply voltage VDD. Nodes A of the switches of group G2 are connected to nodes A of the switches of group G1 via a resistor 40. Similarly, nodes A of the switches of a group Gi (where i ranges between 2 and n) are connected to nodes A of the switches of group Gi-1 via a resistor 40.

In this embodiment, inverters 38 of switches 30" of a same group have the same supply voltage and the inverters of two different groups have different supply voltages. The speed at which each inverter can bring a load (stage 26) connected to its output S to a voltage corresponding to a high logic state depends on the supply voltage of this inverter. Thus, the delays introduced by switches 30" of groups G1, G2, . . . Gn depend on the supply voltage of the respective inverters 38 of these switches. The supply voltage of inverters 38 depends on the voltage drops in resistors 40 and these voltage drops depend on the number of inverters 38 with a state that switches. When the number of activated cells is large, which, in prior art, would cause high current peaks in transistor 22, the number of inverters 38 having a state that switches is large and the voltage drops in resistors 40 are significant. As a result, the delays introduced by switches 30" of groups G1, G2, . . . Gn are long, which reduces the current peaks in transistor 22. When the number of activated cells is small, the number of inverters 38 having a state that switches is small and the voltage drops in resistors 40 are small. The delays introduced by switches 30" of groups G1, G2, . . . Gn are then short and the line selection time is thus short. Such a control circuit thus operates at an optimal speed while having transistors 22 of reduced size.

Of course, the present invention is likely to have various alterations, modifications, and improvements which will readily occur to those skilled in the art. In particular, embodiments of the present invention in which the column activation signal is delayed from a single enable signal VAL have been described, but those skilled in the art will easily adapt the present invention to an embodiment in which several delayed enable signals VAL generated based on an initial signal VAL are used.

The present invention has been described in relation with logic switches (30', 30") provided for receiving and providing logic signals that are active at a high state, but those skilled in the art will easily adapt the present invention to logic switches provided for receiving and providing logic signals that are active at a low state.

Further, the present invention has been described in relation with a logic switch (30', 30"), the output of which is provided by an inverter (36, 38) provided for introducing a predetermined delay, but those skilled in the art will easily adapt the present invention to a logic switch also including other elements (such as a logic NAND gate) provided for introducing a predetermined delay.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A circuit for controlling an array of cells of a plasma screen, each cell of the array of cells being disposed at a corresponding intersection of one of a plurality of lines and one of a plurality of columns, comprising:

a plurality of line control blocks, each line control block configured to apply a line activation signal to a corresponding one of the plurality of lines; and a plurality of column control blocks, each column control block configured to apply a column activation signal to a corresponding one of the plurality of columns, and each column control block comprising a delay device adapted to control application of the activation signal to the column corresponding to the control block, a first of the plurality of column control blocks configured to provide a first delay in applying the activation signal to the column of the plasma screen corresponding to the first control block and a second of the plurality of column control blocks configured to provide a second delay in applying the activation signal to the column of the plasma screen corresponding to the second control block, the first delay being different than the second delay.

2. The circuit of claim 1, wherein each of the delay devices is configured and arranged such that a single enable signal activates each of the delay devices.

3. The circuit of claim 1, wherein at least one of the plurality of column control blocks further comprises an output stage connected between a delay device and a corresponding column, to apply the column activation signal to the corresponding column.

4. The circuit of claim 1, wherein at least one of the plurality of column blocks control includes:

a NAND gate having a first input for receiving a logic signal to control application of the column activation signal to a corresponding one of the plurality of columns, a second input for receiving an enable signal; and a delay element to control the speed at which the activation signal is applied to the corresponding one of the plurality of columns, the delay element having an input connected to an output of the NAND gate, and an output connected to the corresponding one of the plurality of columns.

5. The circuit of claim 4, wherein the delay element is an inverter.

6. The circuit of claim 5, wherein the inverter includes an N-type MOS transistor connected between ground and an inverter output, and a P-type MOS transistor connected between a voltage supply line and the inverter output.

7. The circuit of claim 6, further comprising an output stage, connected between the inverter output and the column, to provide the activation signal to the column.

8. The circuit of claim 6, further comprising a memory element connected to the first input of the NAND gate to provide the logic signal.

9. The circuit of claim 1, wherein the plurality of column control blocks form a plurality of groups, each of the column control blocks comprising one of the plurality of groups adapted to apply the column activation signal to a corresponding one of the plurality of columns at the same time as the others comprising the one of the plurality of groups, and a first of the plurality of groups adapted to apply the column activation signal at a first time and a second of the plurality of groups adapted to apply the column activation signal at a second time.

10. The circuit of claim 9, wherein each delay device is connected to ground and is connected to a corresponding voltage supply node, the delay elements comprising one of the plurality of groups being connected to one of the voltage supply nodes, each of the plurality of supply nodes being connected to another of the plurality of supply nodes by a corresponding resistor.

11. A method of controlling an array of cells of a plasma screen, each cell of the array of cells being disposed at a corresponding intersection of one of a plurality of lines and one of a plurality of columns, comprising:

activating at least one of the plurality of lines;

initiating application of a first column activation signal to a first of the plurality of columns of the plasma screen, at a first time; and initiating application of a second column activation signal to a second of the plurality of columns of the plasma screen, at a second time, the second time being distinct from the first time, and both the first time and the second time occurring during the activating step.

12. The method of claim 11, wherein the step of initiating application of a first column activation signal to a first of the plurality of columns includes switching a first transistor connected between a first voltage and a first output connected to a first of the plurality of columns, and the step of initiating application of a second column activation signal to a second of the plurality of columns includes switching a transistor connected between a second voltage and a second output connected to a second of the plurality of columns, the second voltage being different than the first voltage.

13. The method of claim 12, wherein the first transistor and the second transistor are both P-type MOS transistors.

14. The method of claim 13, wherein the switching speed of the first transistor is determined by the first voltage and the width-to-length ratio of the first transistor, and the switching speed of the second transistor is determined by the second voltage and the width-to-length ratio of the second transistor.

15. The method of claim 11, wherein the step of initiating application of a first column activation signal to a first of the plurality of columns is performed in response to a logic signal.

16. A circuit for controlling the cells of a plasma screen of array type, formed of cells arranged at intersections of lines and columns, including line control blocks for sequentially activating each line, and including column control blocks for, as each line is activated, applying an activation potential to selected columns, each column control block including predetermined delay means for delaying the application of the activation potential to the selected columns, the predetermined delay means of each column control block being connected to be activated by a same enable signal, the column control blocks forming a plurality of predetermined groups, the column control blocks of a same group applying said activation potential with a same delay and the column control blocks of different groups applying said activation potential with a different delay, said circuit also comprising means for modifying the value of each delay according to the number of selected columns.

17. The circuit of claim 16, wherein each column control block includes delay means comprising a NAND gate having a first input which receives a column selection signal, a second input which receives said enable signal, and an output connected to the input of an inverter supplied between a ground and a supply node, the supply nodes of the inverters of a same group being interconnected, the supply nodes of the inverters of a first group being connected to a supply voltage and the supply nodes of the inverters of each following group being separated from the supply nodes of the inverters of a preceding group by a resistor.

18. A process for controlling the cells of a plasma screen of array type, formed of cells arranged at intersections of lines and columns, including the steps of sequentially activating each line, and, as each line is activated, commanding by a same enable signal the activation of the selected columns, wherein each selected column is activated by a column control block with a delay particular to each block, the column control blocks forming a plurality of predetermined groups, the column control blocks of a same group activating the columns with a same delay and the column control blocks of different groups activating the columns with a different delay, the value of each delay depending on the number of selected columns.

* * * * *